US009593850B2

(12) United States Patent
Mooney

(10) Patent No.: US 9,593,850 B2
(45) Date of Patent: Mar. 14, 2017

(54) BOTTOM ASH DEWATERING SYSTEM USING A REMOTE SUBMERGED SCRAPER CONVEYOR

(75) Inventor: Gary D. Mooney, Phoenixville, PA (US)

(73) Assignee: CLYDE BERGEMANN, INC., Atlanta, GA (US)

( * ) Notice: Subject to any disclaimer, the term of this patent is extended or adjusted under 35 U.S.C. 154(b) by 920 days.

(21) Appl. No.: 12/913,157

(22) Filed: Oct. 27, 2010

(65) Prior Publication Data

US 2011/0226194 A1 Sep. 22, 2011

Related U.S. Application Data

(60) Provisional application No. 61/316,159, filed on Mar. 22, 2010.

(51) Int. Cl.
*F22B 37/48* (2006.01)
*F23J 1/02* (2006.01)

(52) U.S. Cl.
CPC ..... *F23J 1/02* (2013.01); *F23J 2900/01004* (2013.01)

(58) Field of Classification Search
USPC ..... 110/165 R, 166–171, 259; 122/396
See application file for complete search history.

(56) References Cited

U.S. PATENT DOCUMENTS 2,706,136 A * 4/1955 Hughes ..... F23J 3/06 406/120
3,094,953 A * 6/1963 Alexander ..... F23J 1/00 110/171
3,456,798 A * 7/1969 Urdanoff ..... 210/776
3,915,105 A 10/1975 Michelbrink
(Continued)

FOREIGN PATENT DOCUMENTS

CA 1208506 7/1986
DE 100 15 435 A1 10/2001
(Continued)

OTHER PUBLICATIONS

"International Search Report and Written Opinion of the International Search Authority" mailed Jun. 29, 2016, International Application No. PCT/US2016/013581.

*Primary Examiner* — Alissa Tompkins
*Assistant Examiner* — Nathaniel Herzfeld
(74) *Attorney, Agent, or Firm* — Morris, Manning & Martin, LLLP; Daniel E. Sineway, Esq.

(57) ABSTRACT

Remote submerged scraper conveyor (SSC) consists of a conventional SSC modified to include a slurry processing system, which allows it to be located remotely from associated boilers at or slightly above grade level rather than directly under a boiler like a conventional SSC. The slurry processing system includes a pair of overflow troughs 34 and associated weirs located exterior to and along the top edge of each side of the horizontal section of the SSC and an underflow baffle, which extends from a position above the water line down into the horizontal section of the SSC below the water line. The slurry processing system allows the Remote SSC to receive a high volume wet ash slurry discharge via a slurry discharge pipe conventionally sent to an ash pond or a tall dewatering bin system.

24 Claims, 13 Drawing Sheets

(56) References Cited

U.S. PATENT DOCUMENTS

| | | | | | |
|---|---|---|---|---|---|
| 3,962,978 | A | * | 6/1976 | Bosman | F28C 3/12 110/165 R |
| 4,112,856 | A | * | 9/1978 | Fuhrman et al. | 110/165 R |
| 4,212,682 | A | * | 7/1980 | Burkett | C04B 18/06 106/401 |
| 4,213,402 | A | | 7/1980 | Kochey | |
| 4,286,527 | A | | 9/1981 | Robinson et al. | |
| 4,301,746 | A | * | 11/1981 | Pech | F23J 1/02 110/165 R |
| 4,329,929 | A | | 5/1982 | Jessen | |
| 4,429,640 | A | * | 2/1984 | Sullivan | 110/165 R |
| 4,512,265 | A | * | 4/1985 | Buchmuller | F23J 1/02 110/165 R |
| 4,545,305 | A | * | 10/1985 | Howard et al. | 110/165 R |
| 4,897,201 | A | * | 1/1990 | Yamamoto | B01F 17/0085 210/728 |
| 5,799,595 | A | * | 9/1998 | Michelbrink | F23J 1/02 110/167 |
| 2010/0170425 | A1 | * | 7/2010 | Magaldi | 110/165 R |
| 2011/0226194 | A1 | | 9/2011 | Mooney | |

FOREIGN PATENT DOCUMENTS

| | | | | | |
|---|---|---|---|---|---|
| GB | 197847 | | | 5/1923 | |
| JP | 58219317 | A | * | 12/1983 | F23J 1/02 |

* cited by examiner

CURRENT SITUATION (PRIOR ART)

BOTTOM ASH DEWATERING SYSTEM USING A REMOTE SUBMERGED SCRAPER CONVEYOR

This application claims priority to commonly-owned U.S. Provisional Patent Application No. 61/316,159 entitled "Bottom Ash Dewatering System Using a Submerged Scraper Conveyor (SSC)" filed Mar. 22, 2010, which is incorporated herein by reference.

TECHNICAL FIELD

Background

Bottom ash refers to the non-combustible constituents of coal with traces of combustibles that are embedded in clinkers and that stick to the hot side water walls of a coal-burning furnace during its operation. Bottom ash may be used as an aggregate in road construction and concrete. The portion of the ash that escapes up the chimney or stack is, however, referred to as fly ash. The clinkers fall by themselves to the bottom of the furnace and get cooled, typically in a water impounded ash hopper.

The clinker lumps get crushed to small sizes by clinker grinders and fall down into a trough from where a water ejector pumps them out to a sump or ash pond. In another arrangement a continuous link chain scrapes out the clinkers from under water and deposits them in a bunker outside the boiler room wall.

An alternative bottom ash handling system is the dry conveyor which is a unique system for dry extraction, cooling and handling of bottom ash from pulverized coal-fired boilers. It eliminates water usage in the cooling and conveying of bottom ash. This system cools ash using only a small controlled amount of ambient air.

The two most common bottom ash handling systems used for dewatering bottom ash are conventional tall dewatering bins and Submerged Scraper Conveyors (SSC). Both of these distinct systems produce a relatively "dry" and dewatered product that is nominally 15 to 20% water by weight and presently acceptable for over the road transport in open top dump trucks covered by a loose tarpaulin. The main difference between these two systems is that the SSC achieves the 20% water by weight result continuously while the dewatering bins require a 6 to 8 hour decanting time cycle to allow the water retained by the ash to seep out through decanting screens.

Ash dewatering in a conventional tall dewatering bin system can be divided into several basic time periods. Initially, all of the water flowing through a discharge pipeline leading away from the ash hopper under a boiler is conveyed up the sidewall of a tall dewatering bin and deposited into the middle of an underflow baffle at the top of the bin. No "dewatering" occurs at this time but the bottom ash starts to separate from the conveying water and drop to the bottom of the bin. This naturally reduces the water content of the ash to about 50% water by volume since bottom ash is considered to have 50% voids as well as a basic 45-50 pound per cubic foot (721 to 801 kg/cubic meter) bulk density. The conveying water in this phase flows under an underflow baffle and upwards and over to an overflow trough that is installed around the inner perimeter of the bin. This overflow trough can have a flat top edge or a serrated weir or some other form of screening to prevent smaller ash particles from leaving the bin. Nevertheless, the parts per million (ppm) of particles leaving the bin in this stage can exceed 1,000 ppm. After the initial conveying water flow is finished, or at least diverted to another dewatering bin, the dewatering bin no longer overflows. The high water flow stops. At that point decanting valves are opened to allow the upper water level and ash water content to be siphoned off from above the layer of ash as well as from between the interstitial voids in the ash itself. The bin is lined with multiple decanting screens and other decanters to slowly allow water to trickle out of the ash, past the screens in the decanters, and down through drain troughs and drain pipes to a settling pond, tank, basin or sump. If the water flow rate is controlled by the setting on the drain valves (not fully open at all times), the particulate carryover rate can be reduced below 500 ppm during this stage.

Whether a conventional tall dewatering bin or an SSC is used to dewater the ash, the overflow water from either system contains too much particulate to allow it to be returned to the environment without further treatment. Generally a two step process is used. Water overflowing a dewatering bin or SSC flows initially to a holding "area" where the water flow rates are greatly reduced and additional particulate is allowed to "settle." This accumulated "sludge" of fine particles can be pumped back to the dewatering bin or SSC but should be kept away from any decanting screen areas. After moving through the "settling" area of a pond, tank or sump, the water is clearer and the particulate content has been reduced to ~100 ppm. It is then allowed to overflow into a storage area to await possible recirculation back to the boiler/ash hopper areas of the plant. If a pond is not used, a "surge" tank is used to hold sufficient water to start up the bottom ash system for each boiler by filling all pipelines and one or more dewatering bins.

The advantage of an SSC over a conventional tall dewatering bin system in the overflow water process is that typically the water flows are much less with an SSC system. In a typical SSC system, the maximum incoming water flow is associated with the mill rejects system(s) where each jet pump at each mill discharges approximately 400 to 1,000 Gallons per Minute (GPM) (91 to 227 cubic meters/hr) to the SSC. Mill rejects need to be conveyed at ~10 feet per second (11 km/hr) while bottom ash can be conveyed at ~7.5 feet per second (~8.2 km/hr). Mill rejects often need only 4" to 6" (10 to 15 cm) pipelines to the SSC where bottom ash lines to ponds or dewatering bins may be 8" to 14" (20 to 36 cm) in diameter due to the larger ash generation rates and conveying distances.

As a result, only the tall dewatering bin system is capable of handling the high volume bottom ash slurry discharges currently pumped to ash ponds. Conventional SSCs, which are not equipped to handle these high volume discharges, have previously been located under dedicated boilers. There is, therefore, a continuing need for improved bottom ash dewatering systems that can take advantage of the benefits of the SSC as well as the tall dewatering bins for high volume bottom ash slurry discharges including those currently pumped to ash ponds.

SUMMARY OF THE INVENTION

The present invention may be embodied in a bottom ash dewatering system for a boiler that includes a submerged scraper conveyor located remotely from the boiler at or above grade level (Remote SSC). The submerged scraper conveyor includes a horizontal section, a dewatering incline section, a conveyor running through the horizontal and dewatering incline sections, and a slurry processing system. A slurry processing system, which is integrated with the horizontal section of the submerged scraper conveyor, receives a bottom ash slurry discharge from a remotely located ash hopper under the boiler. The slurry processing system includes an overflow trough system with a first overflow trough located exterior to and alongside an upper edge of a first side of the horizontal section of the submerged scraper conveyor and a second overflow trough located exterior to and alongside an upper edge of a second side of the horizontal section of the submerged scraper conveyor. It also includes a weir system with a first weir located in a first water flow direction between the horizontal section of the submerged scraper conveyor and the first overflow trough and a second weir located in a second water flow direction between the horizontal section of the submerged scraper conveyor and the second overflow trough.

The slurry processing system may also include an underflow baffle system located within the horizontal section of the submerged scraper conveyor for directing the slurry downwards toward the conveyor to allow ash to settle out of the slurry by gravity while forcing water to follow a tortuous path downward and then upward around the underflow baffle system. The underflow baffle system may have an open or closed top box structure located partially above the horizontal section of submerged scraper conveyor that extends downward to a position below a water line in the horizontal section of the submerged scraper conveyor.

As an alternative, the bottom ash dewatering may further include a wet ash hydraulic distribution system for selectively delivering bottom ash slurry discharges to the slurry processing system from multiple boilers and an ash removal control system for remotely controlling the wet ash hydraulic distribution system. Another alternative includes a dewatered ash distribution system for selectively conveying dewatered ash discharged from the submerged scraper conveyor to a plurality further dewatering locations, which may also be remotely controlled by the ash removal control system. The further dewatering locations typically include one or more dewatering bins.

The bottom ash slurry discharge typically exhibits a flow of at least 1,000 gallons-per-minute (227 cubic meters/hr) while the submerged scraper conveyor is configured to discharge dewatered ash having water content not greater than 20% water by weight. When additional dewatering bins are used, they further dry the ash to not greater than 15% water by weight.

It will be further illustrated how the present invention avoids the drawbacks of prior bottom ash dewatering systems and provides an improved Remote SSC with a number of significant advantages. The specific techniques and structures for creating the Remote SSC, and thereby accomplishing the advantages described above, will become apparent from the following detailed description of the embodiments and the appended drawings and claims.

DETAILED DESCRIPTION OF THE PREFERRED EMBODIMENTS

Figure 1:
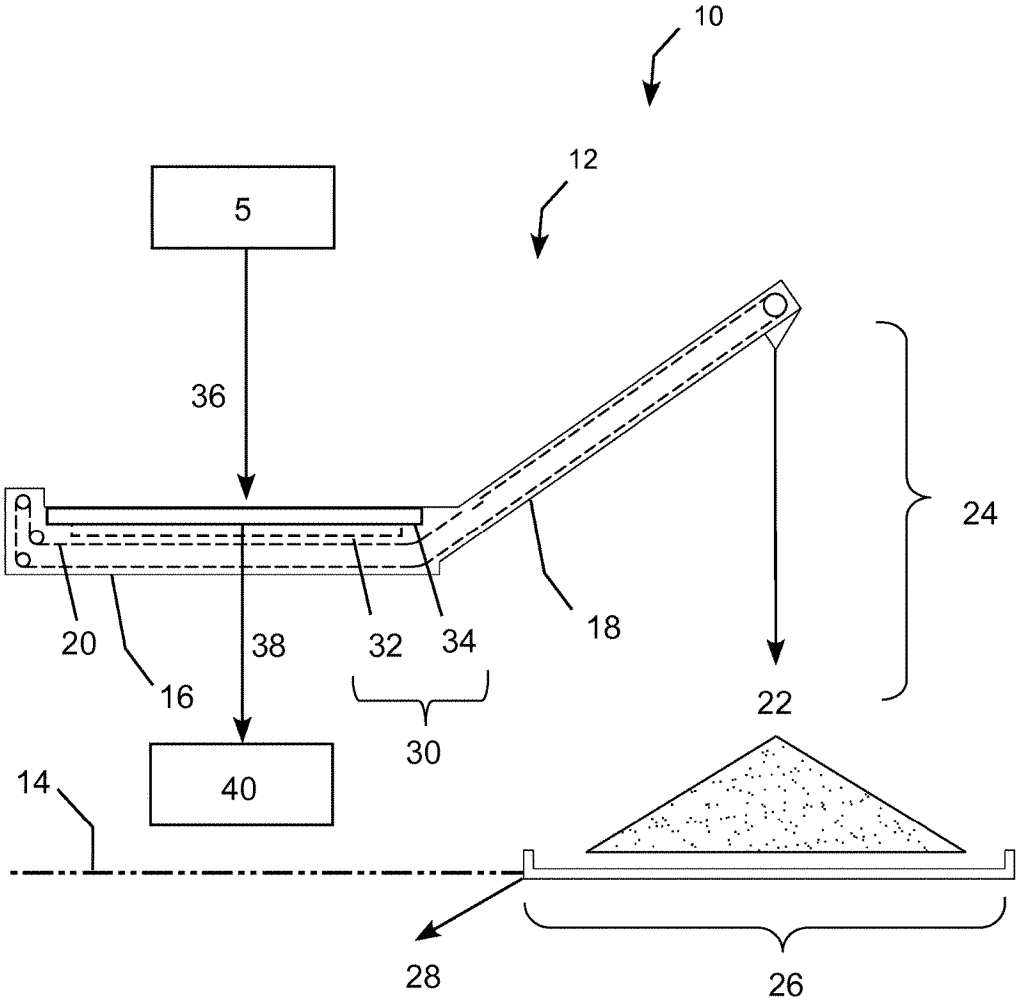
FIG. 1 is a conceptual illustration of a remote submerged scraper conveyor (Remote SSC) according to the present invention.

The present invention may be embodied in a Remote Submerged Scraper Conveyor (Remote SSC) bottom ash dewatering system, which represents a new technique for dewatering bottom ash from a coal-fired boiler developed by repositioning known and proven equipment in new locations to offer a unique cost savings design. The Remote SSC is located at some distance from the boiler instead of being positioned directly under the boiler like a conventional SSC. The Remote SSC also includes a slurry processing system integrated with the horizontal section of the SSC allowing it to handle the high volume of wet bottom ash slurry conventionally pumped into ash ponds or tall dewatering bins. Existing (or new) hydraulic sluice pipelines convey the bottom ash slurry from the boiler area ash hopper to the Remote SSC, instead of to the ash ponds or tall dewatering bins. As a result, much higher amounts of water and slurry enter the Remote SSC than enter a conventional SSC located under a boiler. The slurry processing system integrated with the horizontal section accommodates this increased level of water overflow in the Remote SSC using designs similar to proven techniques in the upper levels of conventional tall dewatering bins.

In the Remote SSC dewatering system, the SSC's function is mainly to dewater the bottom ash, as traditional SSCs have been doing successfully in the United States for over thirty (30) years. However, the Remote SSC includes a new slurry processing system integrated with the horizontal section of the SSC that provides a water overflow design and equipment that is larger than "normal" to handle the incoming sluice water of a traditional pond disposal system or tall dewatering bin system. Similar design techniques of conventional tall dewatering bins are used in different and separate locations to address the water underflow, overflow and particulate carryover rates at the Remote SSC. With the inlet to the Remote SSC close to grade level, power savings are achieved by not having to pump the slurry up the top of the tall dewatering bins. The Remote SSC then dewaters the bottom ash, as in a conventional SSC, by carrying it up the incline while the overflow water is directed to drain or further clarification or recirculation. The Remote SSC therefore provides the advantages of the SSC as well as those of conventional tall dewatering bins for high volume bottom ash slurry discharges including those currently pumped to ash ponds. This makes the Remote SSC a highly advantageous replacement option for current ash pond disposal systems that need to be decommissioned.

The Remote SSC therefore provides a modern bottom ash dewatering system for plants that currently pump their bottom ash to ponds and cannot, for a variety of reasons, retrofit mechanical conveyors for continuous removal directly underneath the boiler. These reasons include, but are not limited, to: (1) Ash hoppers that are in pits and surrounded by too much boiler steel and too many pulverizers to allow the installation of just one Submerged Scraper Conveyor, SSC, or Dry Conveyor; (2) The Boiler is a Base Loaded Unit and the amount of Outage Time needed to demolish the existing ash hopper equipment and install a new system (estimated at 6-8 weeks minimum) either is not available or would be too costly in terms of lost revenue; and (3) In plants with multiple Units, the cost of one (or two) common Submerged Scraper Conveyor(s) located away from the Boiler Islands would be less expensive than installing an SSC or Dry Conveyor under each Boiler.

The Remote SSC dewatering system combines the benefits of a conventional SSC with the benefits of a conventional tall dewatering bin system to produce a final bottom ash product that is below 20% water by weight and provides water for reuse with a low particulate level in parts per million (ppm). This combination requires much less power to operate than a totally conventional water recirculation system and provides better control over the final products.

The Remote SSC dewatering system is typically located between the boiler(s) and the ash pond. The SSC typically operates continuously to remove the incoming bottom ash at the bottom ash generation rate. The ash enters the horizontal section of the SSC and is immediately and continuously conveyed up an incline that dewaters the ash to approximately 15-20% water by weight. In other words, the SSC performs a similar function for ash removal that it does when located directly under the boiler, without having to contend with large ash/slag falls from a tall boiler. Since the incoming "batch" rate of the bottom ash system can be as much as two to eight times the ash generation rate, the SSC stores approximately 4 to 8 Hours worth of ash generation—much like they do when positioned directly under the boiler.

Each Remote SSC has a variable speed drive that can increase the chain speed at any time to remove a surge of incoming ash—such as during sootblowing cycles—but slower speeds provide better dewatering. The set speed should set the ash removal rate at the ash generation rate. In the Remote SSC dewatering system, the SSC handles the initial, upper water overflow rate traditionally handled by a tall, circular dewatering bin. The Remote SSC provides the same, or more, linear feet of overflow trough length in a set of straight overflow troughs on one or both sides of the SSC that a traditional dewatering bin has in its upper, circular overflow trough. The initial water overflow rate can therefore be the same for the Remote SSC dewatering system as for a traditional dewatering bin. Various existing techniques can be used to control the water overflowing the SSC to limit particulate carryover.

In a traditional arrangement, two (2) dewatering bins are sized for seventy-two (72) hour storage (total) with truck or railcar removal clearance directly underneath. These dewatering bins can often be 25 to 35 feet (7.6 to 10.7 meter) in diameter or more and require the incoming pipelines to be raised well over fifty feet (15.2 meter) from grade. This "lift" converts directly into an increased total dynamic head (TDH) requirement on the existing high pressure water supply pumps already supplying high pressure water to any existing jet pumps. Even when centrifugal slurry pumps are being used to pump bottom ash to the ponds, they would have to be resized and retrofitted with larger motors to pump the ash to the top of the dewatering bins.

By using a Remote SSC positioned at or slightly above grade and closer than the current pond (design) discharge point, there will no increase, and a possible decrease, in water supply pump TDH, thus eliminating any need for larger motors and any changes to the motor control center (MCC). As a result, the Remote SSC at or slightly above grade performs the same function as the upper overflow trough in a dewatering bin but at a much lower height above grade, thus saving a major amount of horsepower on the water supply pumps.

The Remote SSC dewatering system may also include an optional hydraulic slurry handling system and/or an optional dewatered ash handling system. The hydraulic slurry handling system allows a single Remote SSC to handle the slurry discharges from multiple boilers. The dewatered ash handling system provides for additional dewatering of the ash after the Remote SSC. Following the bottom ash up the SSC incline, normally 12 to 20 feet (3.7 to 6.1 meter) of dry running length of incline above the water level is needed to reach the 20% water by weight level. In most cases, the Remote SSC provides more than 20 feet (6.1 meter) of dry incline length to provide even better dewatering and allow the headroom required to provide the rest of the optional dewatering equipment. Keeping in mind that traditional dewatering bins need 6-8 hours from the end of the incoming batch conveying phase to reach 20% water by weight, using 4-6 hours of stationary (ash) decanting time to take ash that is already less than 20% water by weight reduces its moisture content even further. Two (2) mini-dewatering bins may provide the secondary decanting after the Remote SSC. These have lower decanting screens and water collecting header rings. To distribute the bottom ash from the top of the SSC into either bin the system includes a reversing horizontal belt conveyor.

After each mini-dewatering bin has allowed the water in the full bin to seep out and lower the moisture content of the ash in the bin, the bottom gate opens and deposits the bin contents onto a single belt conveyor located just above grade. This belt conveyor typically runs underneath both mini-dewatering bins and conveys the ash over to the common ash disposal "stockout" area with several days (at least 3 days) storage time. Trucks can be loaded from this stockpile. The mini-dewatering bins will perform the same lower, stationary decanting function as traditional dewatering bins and allow entrained water to seep out of the bottom ash. The ash particulate carryover through the decanting screens should be less due to the absence of the large head of incoming conveying water.

Depending upon the residence time of the ash in the "stockout" area, additional entrained water will seep out and lower the moisture level of the ash even further. A containment trench and water collecting sump with sump pump can be provided to return this water to the SSCs. Consideration should also be given to enclosing the "stockout" area to prevent rainfall from adding water back to the dewatered ash.

The dewatering system may also include an optional water overflow system. Returning to the SSC overflow troughs, there will be thousands of gallons of water per minute (GPM) (hundreds of cubic meters/hour) overflowing the SSC while the "batch" conveying system is in operation (minus a few GPM carried over with the bottom ash up the SSC incline). Again referring back to conventional tall dewatering bin system design logic, a conical bottom circular "settling tank" with underflow baffle and overflow trough can be used or an inground sump. According to typical design techniques (e.g. EPRI Report CS-4880 January 1987), most systems should have a minimum 50 foot (15.2 meter) diameter settling tank with a 45 degree conical bottom and a 4 foot (1.2 meter) cylindrical section. This can be converted to a "required" value for cubic feet of water storage.

If an above settling grade tank is used, it would typically be about 30-40 feet (9.1 to 12.2 meter) tall above grade. Slurry pumps with smaller impeller clearances would be required to lift the SSC overflow water from about 6 feet (2.0 meter) above grade up to the top of the settling tank and over to the middle of the tank. Additional pumps would also be needed for the water draining from the mini-dewatering bins. Alternatively, the Remote SSC can be positioned on a structured steel platform or a higher ground location to drain by gravity to the above ground settling tank.

If a below ground settling sump is used, the SSC and mini-dewatering bins can all drain by gravity into the sump. Any dirty water from the stockout area can also be pumped more easily to this inground sump as well. Assuming a rectangular ground level sump is used, a dividing wall should be used to allow clearer water to overflow into a second "surge" area. Meanwhile, fines that continually settle out in the sump should be constantly pumped back to the base of the incline of the SSC to begin the dewatering process again. This time they will end up in the very middle of the mini-dewatering bins and be more likely to be carried out to the "stockout" pile.

For example, the system could use either a below grade settling area sump with associated lower horsepower pumps or an above grade settling tank with associated higher horsepower pumps. In either case, the resultant "clear" water needs to be stored in sufficient volume in a "surge" tank or pond prior to recirculation back to the boiler island. Optional additional water equipment would allow the water to be released to the environment.

The Remote SSC dewatering system has a number of advantages over traditional dewatering systems. The Remote SSC dewatering system using a grade level SSC in most cases will not require any additional horsepower back at the boiler unit to increase the total dynamic head (TDH) rating on any existing water supply pump or jet pump. There will typically be enough water pressure in the grade level conveying pipelines to convey the ash slurry a few feet of horizontal length and up a small riser to enter the SSC at approximately ten feet (3.0 meter) above local grade. If the SSC is significantly closer than the design pipeline discharge point at the existing ash pond, there may even be a decrease in TDH requirement for the existing pumps.

The system can also use a traditional "settling" tank/sump concept to further filter the SSC overflow water to required industry levels. By controlling the incoming pipeline conveying rates, the number of slurry jet pumps in operation along with decanting bin valve settings, the level of ppm carryover can be lowered even further.

The Remote SSC dewatering system immediately and continuously dewaters the bottom ash to less than 20% water by weight using state of the art SSC technology. In many locations, this is already "dry enough" for immediate truck disposal. The Remote SSC dewatering system uses all of the proven technology of dewatering bins to reduce the particulate carryover in the overflow water. The Remote SSC advantageously separates the two parts of the traditional dewatering bin into the "upper overflow trough" now located on the SSC and the "lower stationary decanting screens" now located as part of mini-dewatering bins. Since the ash leaving the Remote SSC is already "commercially dry" (~20% moisture content ash) the decanting cycle in the mini-dewatering bins can be shorter and much less susceptible to screen plugging due to the elimination of the high hydrostatic heads of water in traditional dewatering bins.

Turning now to the figures, FIG. 1 is a conceptual illustration of a remote submerged scraper conveyor (Remote SSC) 10 according to the present invention. The Remote SSC 10 is based on a conventional SSC 12 that includes a horizontal section 16 and a dewatering incline section 18 with a conveyor 20 that runs through both sections. The conveyor includes flight bars that lift the wet ash separated from the incoming slurry up the dewatering incline section, which dewaters the bottom ash as it rises up the incline. The dewatered ash 22 is dumped from the top of the dewatering incline into a dewatered ash handling system 24, which may include, for example, a discharge chute or secondary conveyor for more distant disposal. In most cases, the dewatered ash is deposited directly or indirectly into an ash pile 26, where a drain 28 removes any additional fluid that seeps from the dewatered ash.

The Remote SSC 10 consists of the conventional SSC 12 described above as modified to include a slurry processing system 30, which allows it to be located remotely from an associated boiler 5 at or slightly above grade level 14 rather than directly under a boiler like a conventional SSC. The slurry processing system 30 includes a pair of overflow troughs 34 and associated weirs (see FIGS. 5A-D) located exterior to and along the top edge of each side of the horizontal section of the SSC. The slurry processing system 30 also typically includes an additional underflow baffle 32, which extends from a position above the water line down into the horizontal section of the SSC below the water line. The slurry processing system 30 allows the Remote SSC 10 to receive a high volume wet ash slurry discharge (e.g. 1,000 to 10,000 GPM) (227 to 2,271 cubic meters/hour) via a slurry discharge pipe 36 conventionally sent to an ash pond or a tall dewatering bin system. A drainage pipe 38 delivers the overflow water collected by the overflow troughs 34 to an overflow water processing system 40 while the bottom ash 22 separated from the overflow water is captured and dewatered by rising up the dewatering incline of the SSC.

Figure 2:
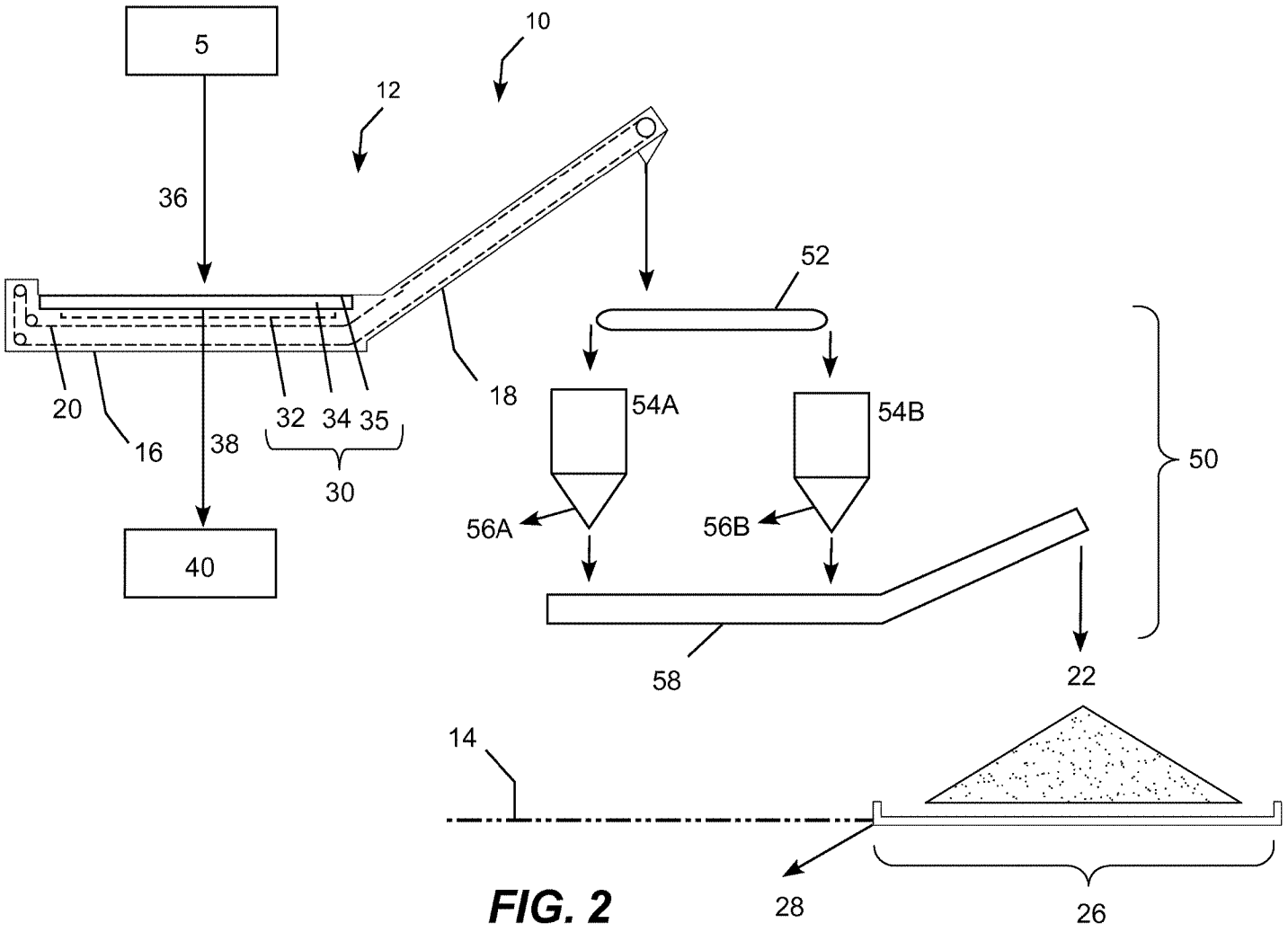
FIG. 2 is a conceptual illustration of the Remote SSC with a dewatered ash distribution system including a pair of mini-dewatering bins and a reciprocating conveyor.

FIG. 2 shows the Remote SSC augmented by a dewatered ash distribution system 50 that includes a pair of mini-dewatering bins 54A-B and a reciprocating conveyor 52 that selectively delivers the dewatered ash 22 to the bins. A secondary conveyor 58 under the mini-dewatering bins 54A-B delivers the dewatered ash from the bins to the ash pile 26. Drains 56A-B remove additional water decanted from the ash in the bins to the overflow water processing system 40. It should be noted that the slurry processing system 30 and the mini-dewatering bins 54A-B provide similar equipment to a conventional tall dewatering bin system except that the overflow troughs and underflow baffle are now located in the slurry processing system 30 integrated with the Remote SSC 10 and the decanting screens are now located in the mini-dewatering bins 54A-B. This configuration has the very significant advantage of providing the same dewatering capacity as the conventional tall dewatering bin system without having to lift the wet ash to the top of the tall dewatering bin. In particular, an existing pump designed to deliver the wet ash slurry to an ash pond will typically be sufficient to pump the wet ash slurry to the Remote SSC 10, whereas new larger capacity pumps would be required to the pump the wet ash slurry to the top of a conventional tall dewatering bin. As a result, the Remote SSC solution saves both the acquisition cost and energy cost needed to operate the new pumps that would otherwise be required to install a conventional tall dewatering bin.

The overflow water processing system 40 may include any of a range of options suitable for a particular application. Typical overflow water options include recirculation of the water back to the boiler, drain to a pond or settling basin, drain to an overflow tank and pump to a pond or basin, drain to a clarifier, or drain to a settling tank then to a surge tank and back to the boiler. The mini-dewatering bins 54A-B provide for additional ash dewatering to augment the dewatering provided by the Remote SSC 10. For example, the water content of the dewatered ash coming from the Remote SSC 10 is typically in the range of 15-20% while the dewatered ash coming from the mini-dewatering bins 54A-B is typically in the range of 10-15%. The specific dewatered ash distribution system 50 shown in FIG. 2 is merely illustrative, and additional bins, conveyors, ash piles and other dewatered ash handling equipment could be utilized as desired.

Figure 3A:
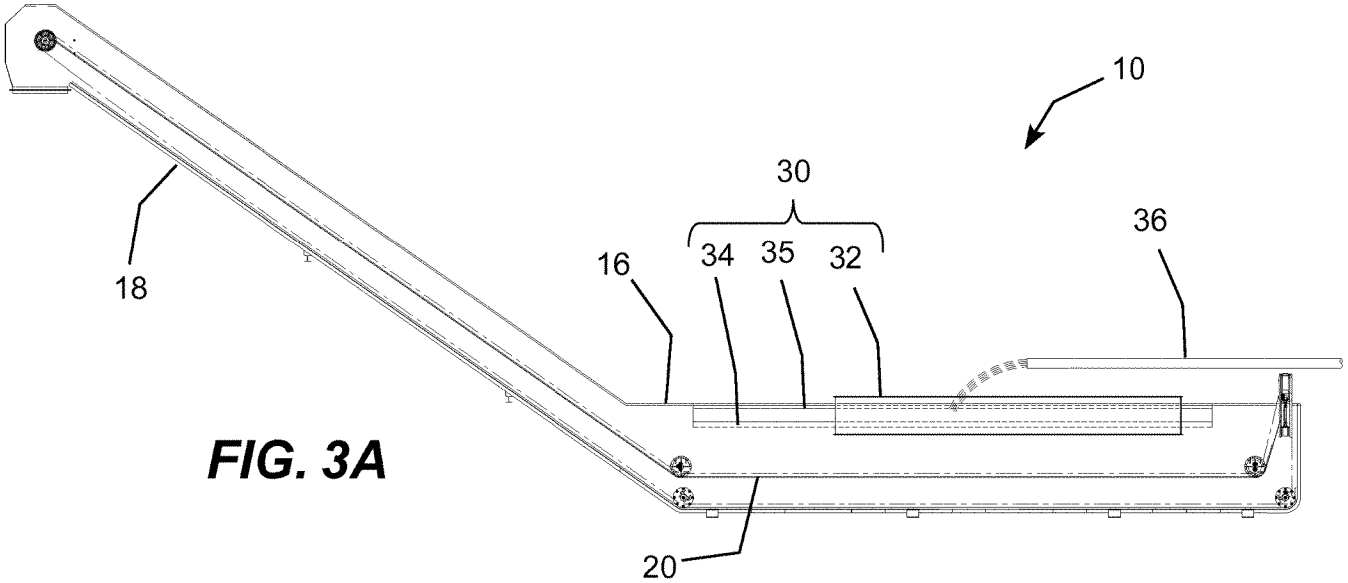
FIG. 3A is a side cut away view of a Remote SSC with an open top underflow baffle.
Figure 3B:
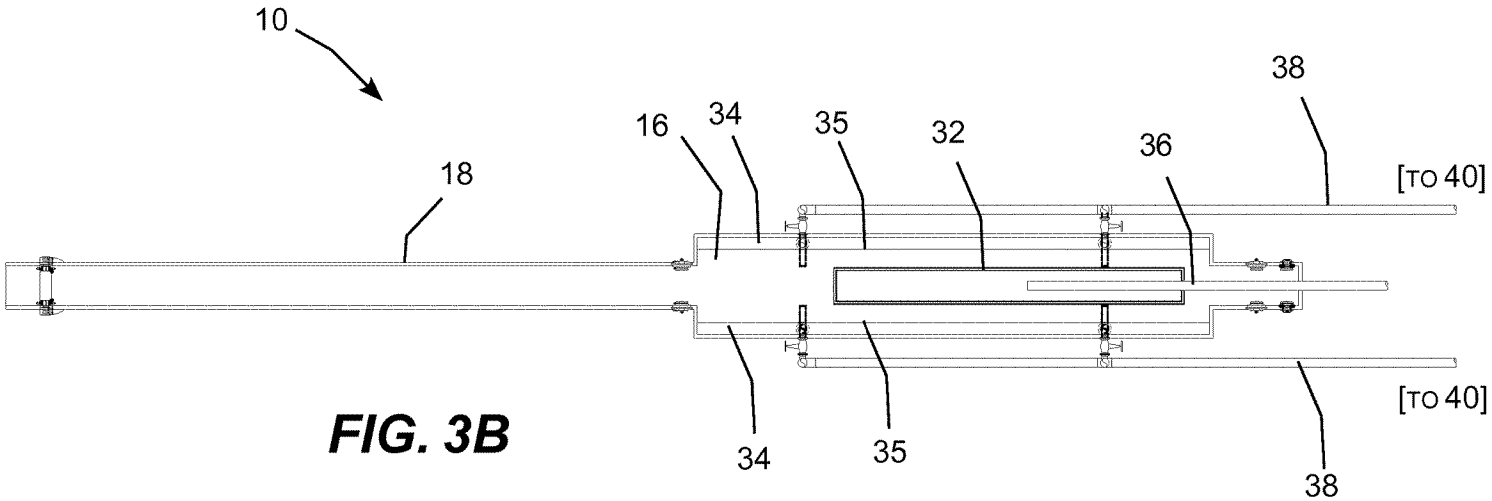
FIG. 3B is a top view of the Remote SSC with the open top underflow baffle.
Figure 3C:
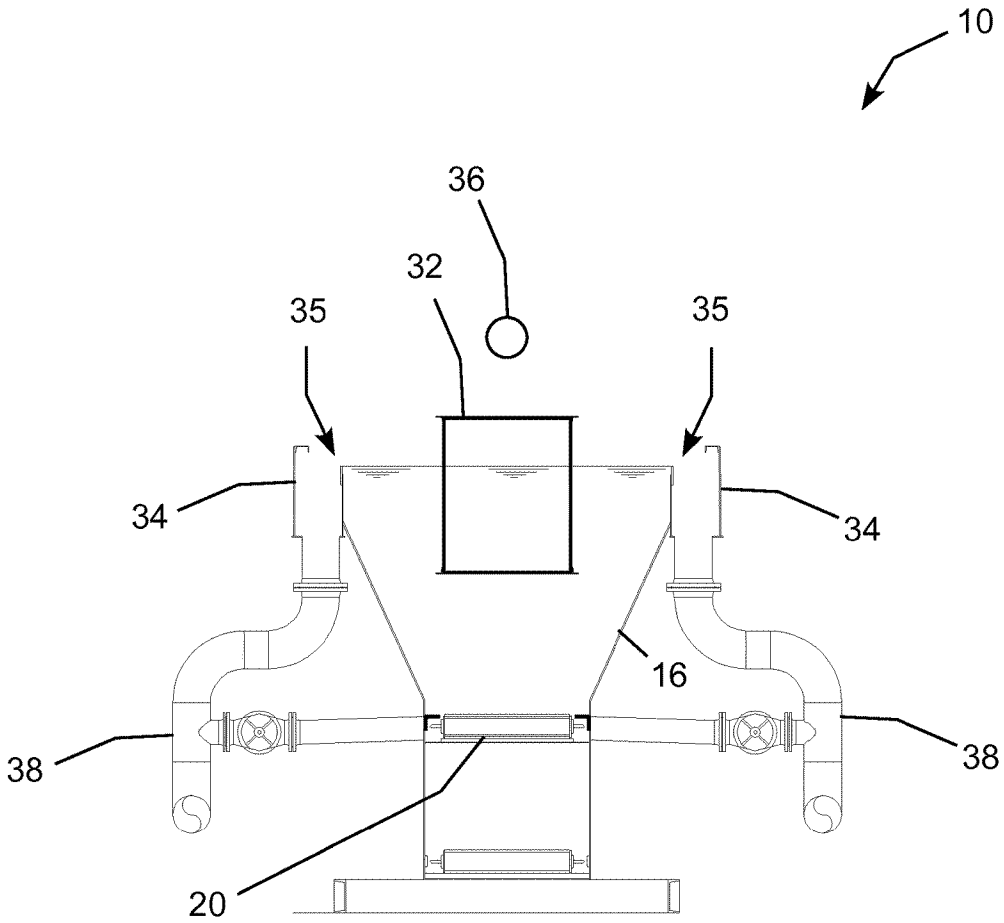
FIG. 3C is a cross-sectional end view of the Remote SSC with the open top underflow baffle.

FIG. 3A is a cut away side view, FIG. 3B is a top view, and FIG. 3C is a cross-sectional end view of a first alternative Remote SSC 10 with an open top underflow baffle shown substantially to scale. This configuration includes an underflow baffle 32 with an open top. The slurry discharge pipe 36 delivers the wet slurry to the underflow baffle and the drain pipes 38 carry the overflow water away from the overflow troughs 34 to the overflow water processing system 40. The slurry processing system 30 includes two overflow troughs 34 each positioned exterior to and alongside a top edge of the horizontal section 16 of the SSC. Together, the overflow troughs are designed to handle the overflow volume of the wet ash slurry from the discharge pipe(s) 36, similar to a conventional tall dewatering bin only integrated with the SSC rather than being located at the top of the tall bin. A weir 35 is located in the water flow direction between the horizontal section of the submerged scraper conveyor and each overflow trough. The weir screens large ash particles from entering the overflow trough 34. FIGS. 5A-D show several typical weir designs.

The underflow baffle 32, which is located above the conveyor 20 in the horizontal section 16 of the submerged scraper conveyor, includes an elongated box having an open top and an open bottom located partially above the horizontal section of the Remote SSC and extending downward to a position below the water line in the horizontal section of SSC. This allows ash to settle out of the slurry by gravity while forcing water to follow a tortuous path downward and then upward around the underflow baffle 32, over the weirs 35, into the overflow troughs 34, into the drain pipes 38, and on to the overflow water processing system 40. The bottom ash settles out of the discharge water on the flight bars of the conveyor 20. The Remote SSC then dries the bottom ash as it lifts the ash up the dewatering incline 18. The bottom ash is then unloaded from the Remote SSC to the dewatered ash handling system to an ash pile directly or through a dewatered ash handling system.

Figure 4A:
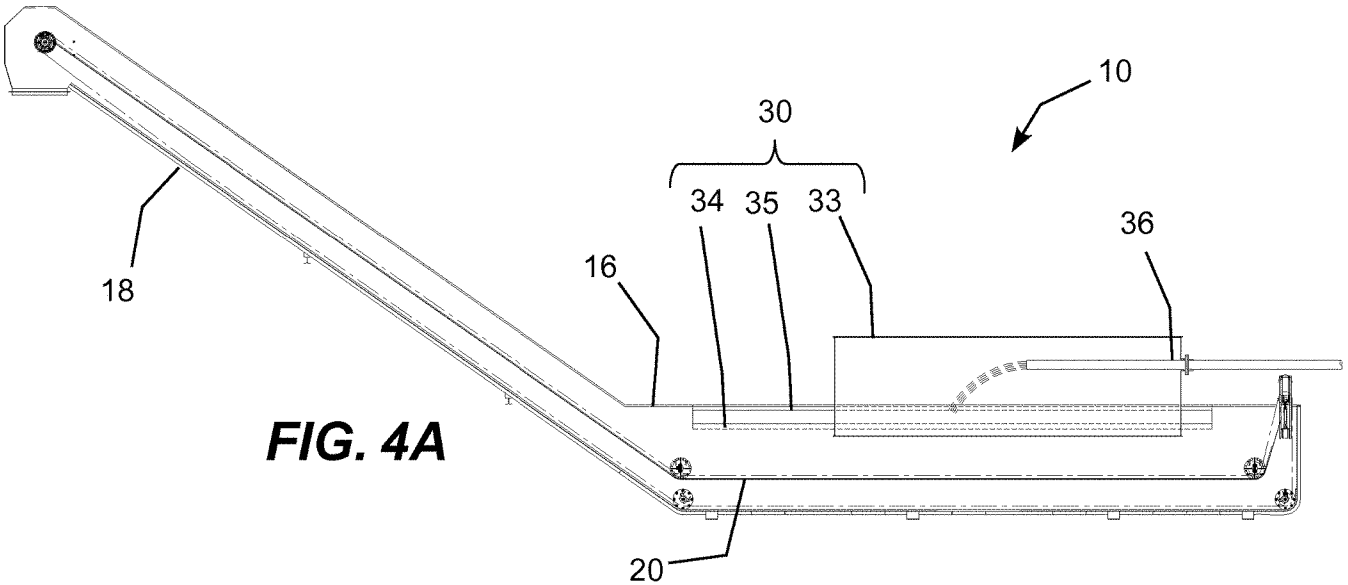
FIG. 4A is a side cut away view of a Remote SSC with an closed top underflow baffle.
Figure 4B:
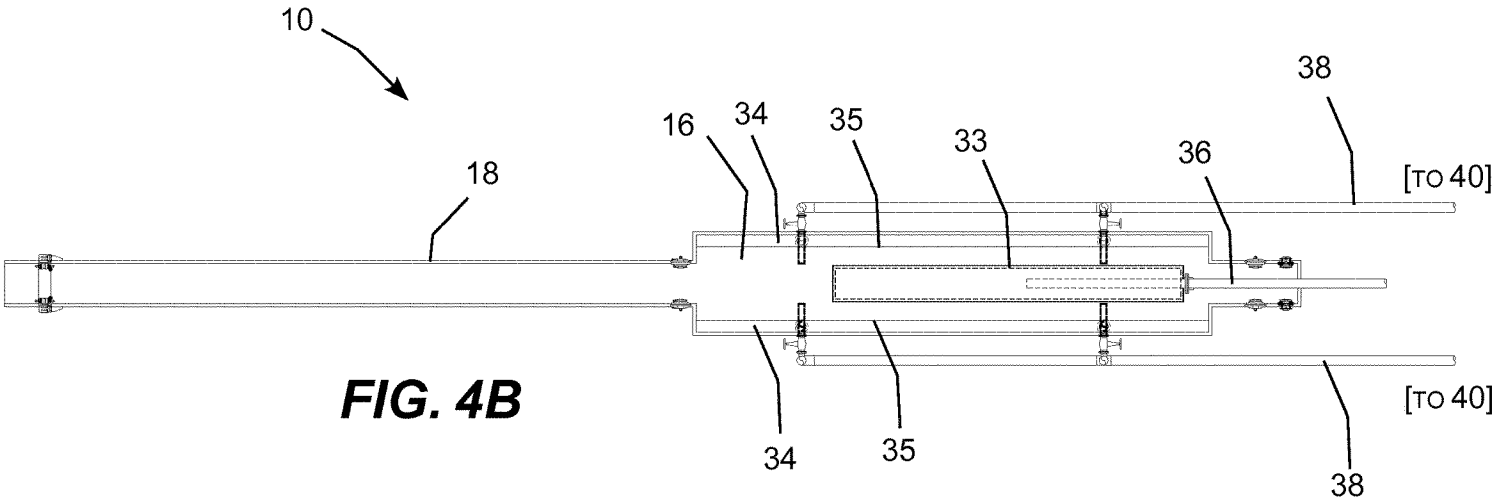
FIG. 4B is a top view of the Remote SSC with the closed top underflow baffle.
Figure 4C:
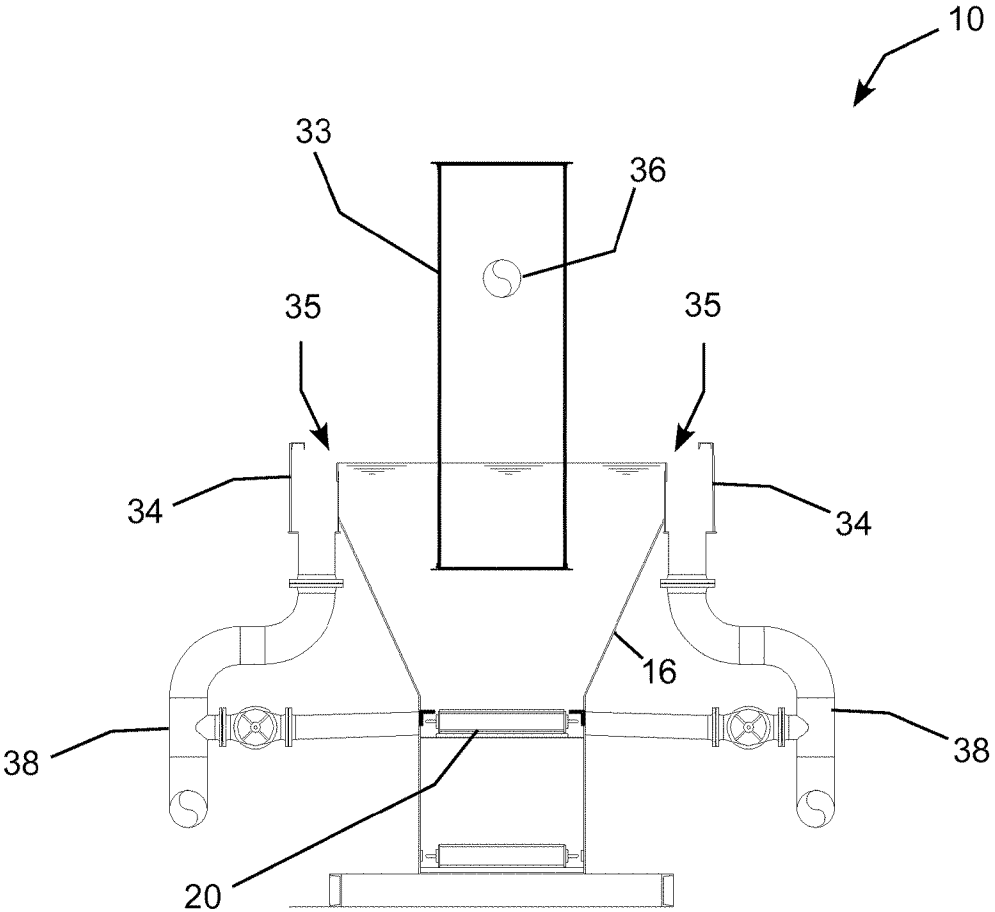
FIG. 4C is a cross-sectional end view of the Remote SSC with the closed top underflow baffle.

FIG. 4A is a cut away side view, FIG. 4B is a top view, and FIG. 4C is a cross-sectional end view of an alternative Remote SSC 11 with a closed top underflow baffle 33 shown substantially to scale. This type of underflow baffle is known as a target box configuration. The slurry discharge may be directed into target impact plates located inside the target box. Otherwise, the Remote SSC 11 is the same as the Remote SSC 10 described with reference to FIGS. 3A-C. The underflow baffles 32 and 33 are typical and other types of baffles may be selected as a matter of design choice.

Figure 5A:
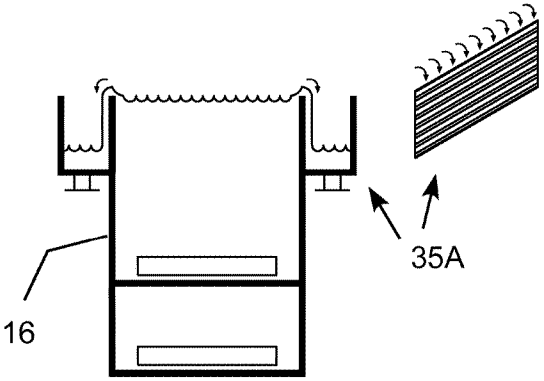
FIG. 5A is a conceptual cross-sectional end view of a flat weir for the overflow trough of the Remote SSC.
Figure 5B:
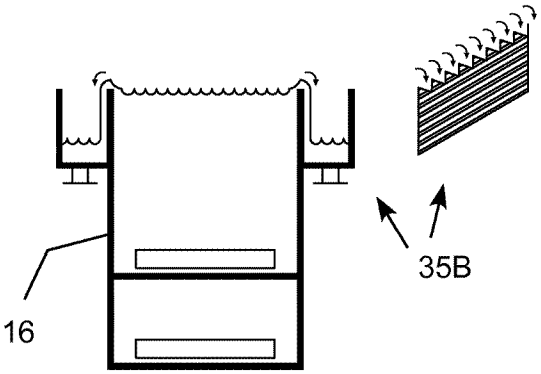
FIG. 5B is a conceptual cross-sectional end view of a serrated weir for the overflow trough of the Remote SSC.
Figure 5C:
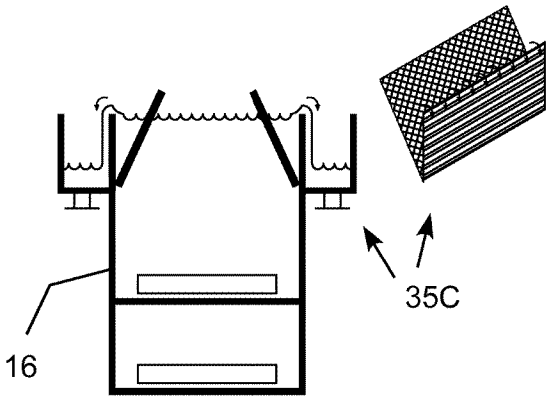
FIG. 5C is a conceptual cross-sectional end view of a mesh screen weir for the overflow trough of the Remote SSC.
Figure 5D:
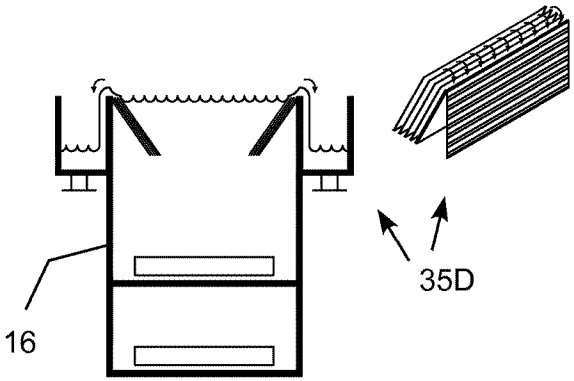
FIG. 5D is a conceptual cross-sectional end view of a parallel plate weir for the overflow trough of the Remote SSC.

FIGS. 5A-D show conceptual cross-sectional end views typical weirs that may be used on the Remote SSC to screen the overflow water as it flows from the horizontal section 16 of the SSC into the overflow trough 34. FIG. 5A illustrates a flat weir 35A, FIG. 5B illustrates a serrated weir 35B, FIG. 5C illustrates a flat weir 35C with an inclined mesh screen, and FIG. 5D illustrates a weir 35D with inclined parallel plates. These weirs are typical and other types of weirs may be selected as a matter of design choice.

Figure 6:
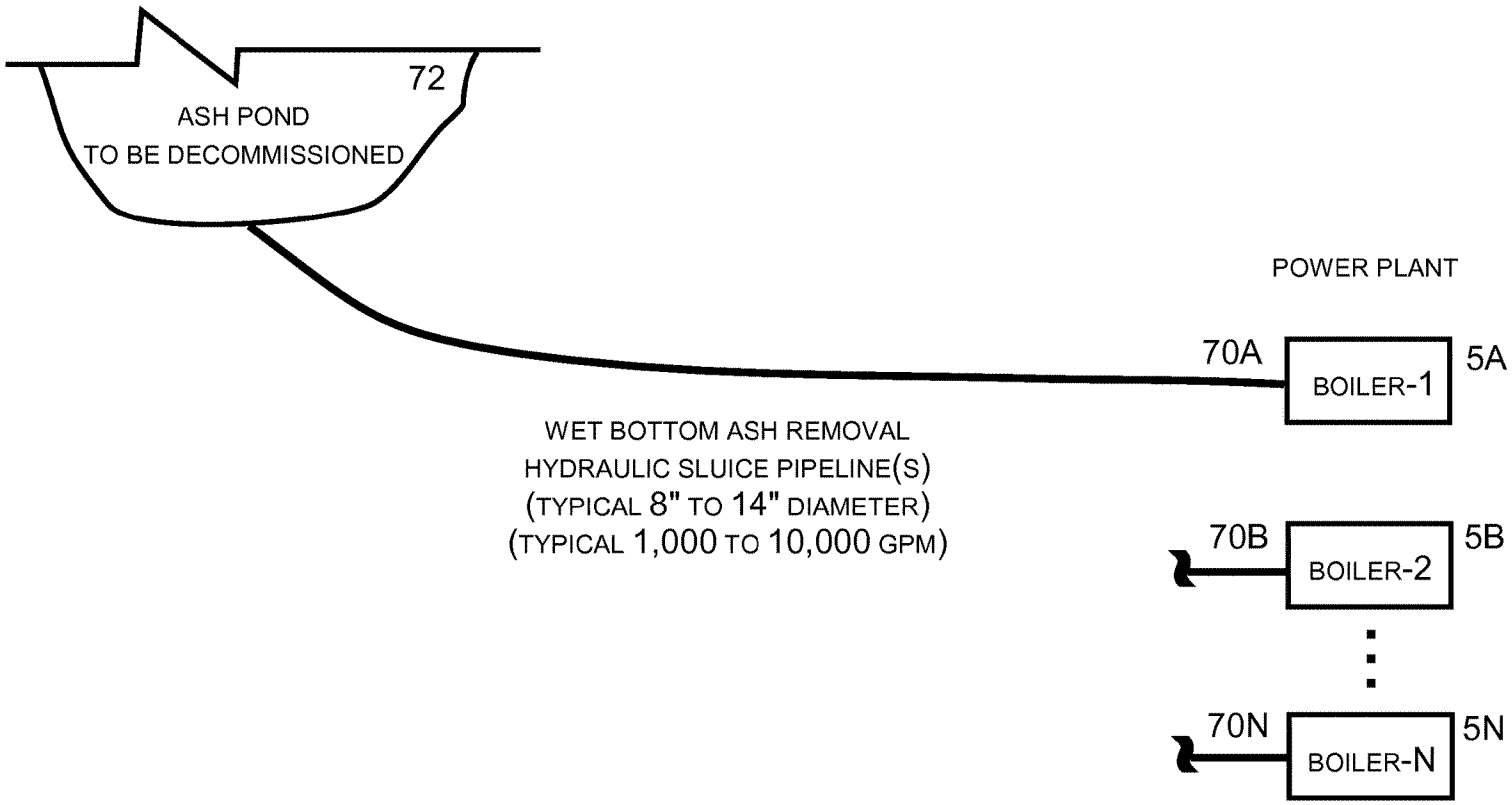
FIG. 6 is a schematic diagram of a prior art bottom ash disposal system including an ash pond to be decommissioned.

FIG. 6 is a schematic diagram of a prior art bottom ash disposal system including an ash pond to be decommissioned. The power plant includes a number of boilers 5A-N that each deliver wet bottom ash slurry to an ash pond 72 by way of a respective discharge pipe 70A-N. These hydraulic sluice pipelines are typically 8 to 14 inches 8" to 14" (20 to 36 cm) in diameter and carry 1,000 to 10,000 GPM (227 to 2,271 cubic meters/hour) of wet bottom ash slurry. The Remote SSC is well adapted to replace the ash pond storage system as many plants are now requiring.

Figure 7:
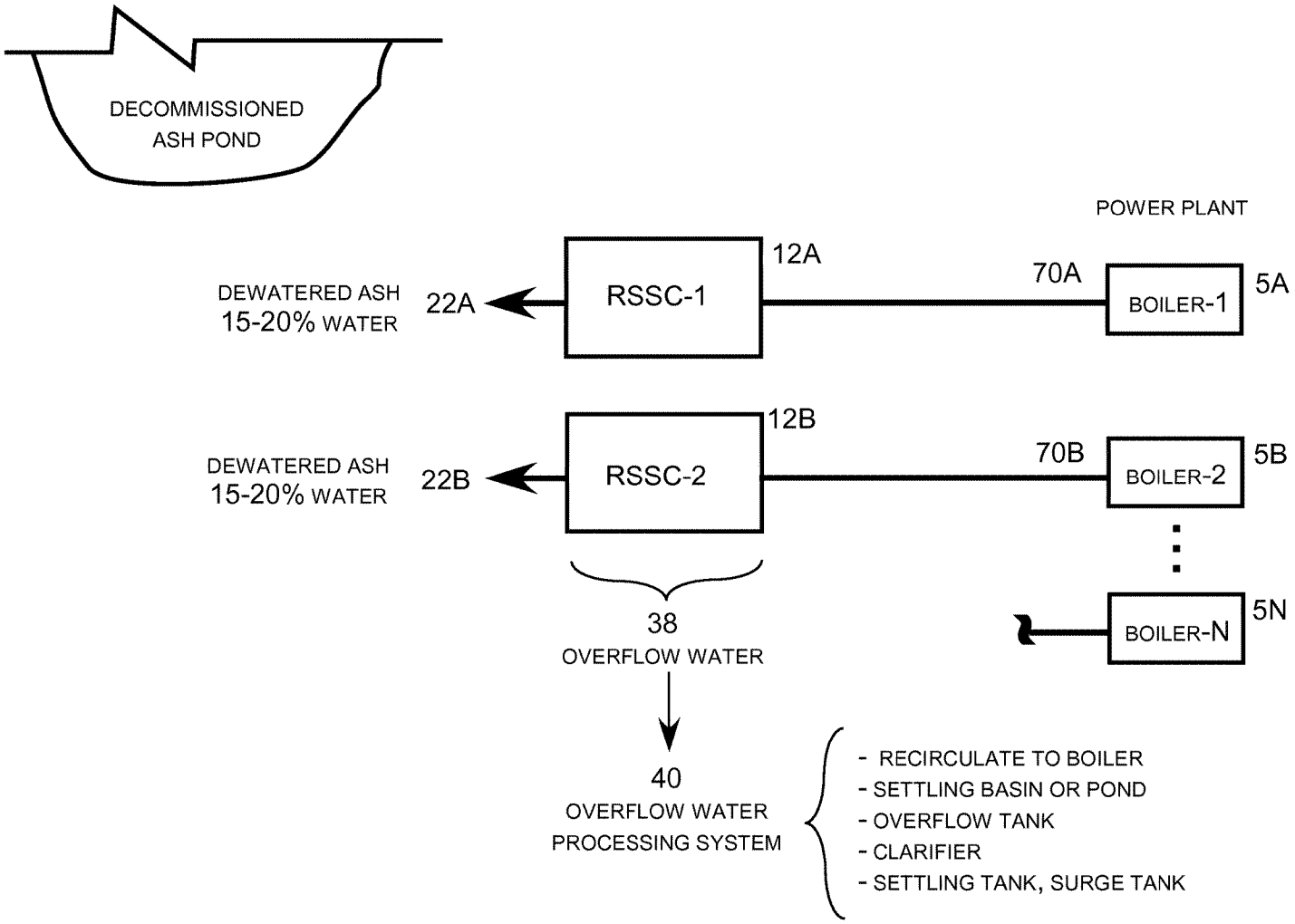
FIG. 7 is a schematic diagram of a Remote SSC bottom ash disposal system with one Remote SSC provided for a respective boiler.

FIG. 7 is a schematic diagram of a Remote SSC bottom ash disposal system with one Remote SSC provided for a respective boiler. That is, the Remote SSC 12A is dedicated to the boiler 5A and the Remote SSC 12B is dedicated to the boiler 5B. The overflow pipes 38 typically drain into a common overflow water handling system 40. The same equipage occurs with conventional SSCs with one SSC located directly under a respective boiler.

Figure 8:
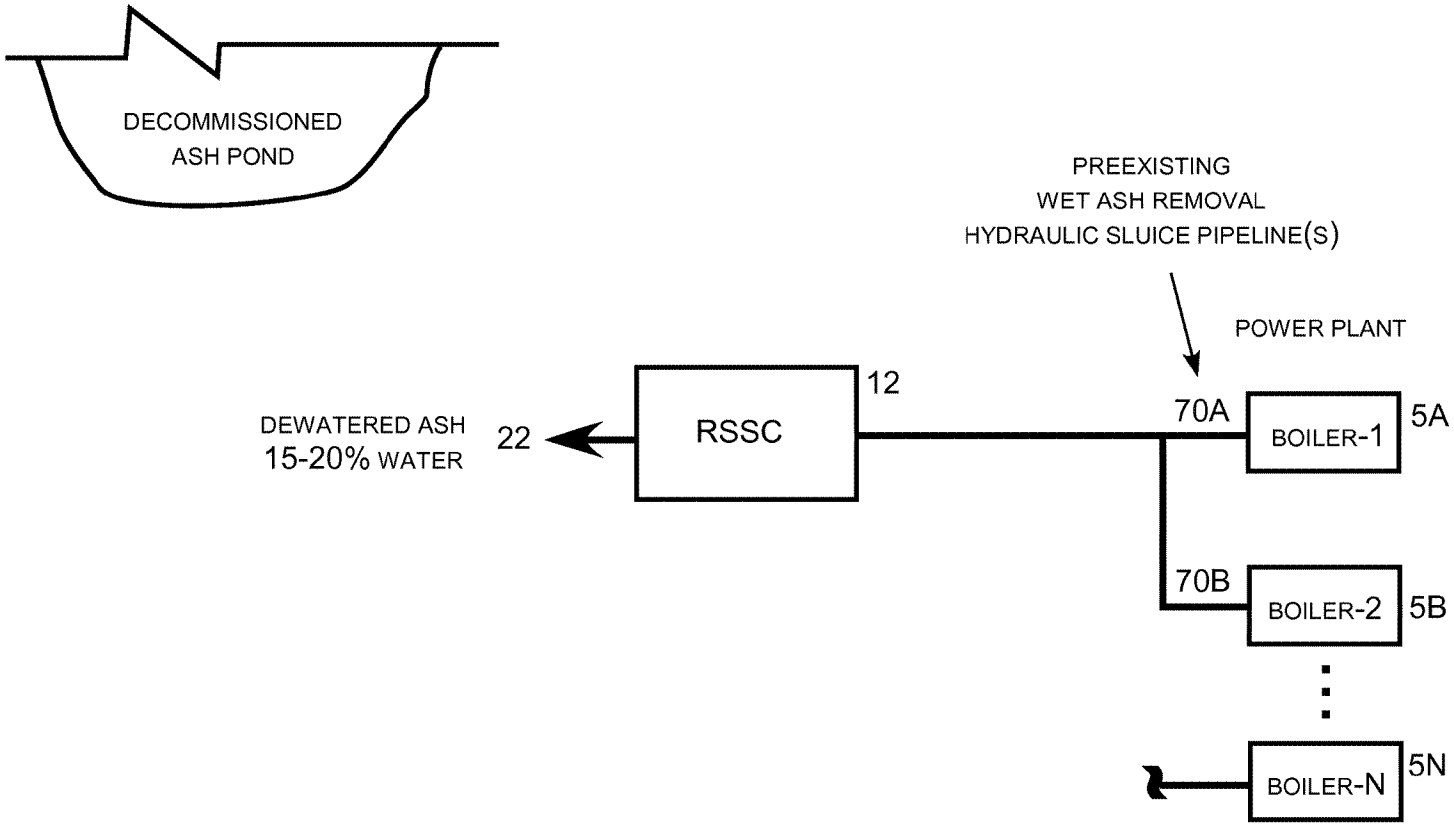
FIG. 8 is a schematic diagram of a Remote SSC bottom ash disposal system in which one Remote SSC is provided for multiple boilers.

As the Remote SSC is located some distance from the boilers, rather than directly under a respective boiler like a conventional SSC, the Remote SSC affords additional design flexibility in which a single Remote SSC may handle the bottom ash discharge from multiple boilers. FIG. 8 is a schematic diagram of a Remote SSC bottom ash disposal system in which one Remote SSC is provided for multiple boilers. That is, a single Remote SSC 12 handles the bottom ash discharges for two boilers 5A and 5B, which can be extended to additional boilers as a matter of design choice. As high volume bottom ash discharges coincide with occasional boiler cleaning (sootblowing) operations, boiler cleaning can be scheduled among the boilers so that a single Remote SSC sized to handle the maximum discharge from a single boiler can handle multiple boilers conducting sootblowing operations at different times. This is a major advantage of the Remote SSC configuration that is not available with the conventional SSC approach in which an SSC is dedicated to and located directly under a respective boiler.

Figure 9:
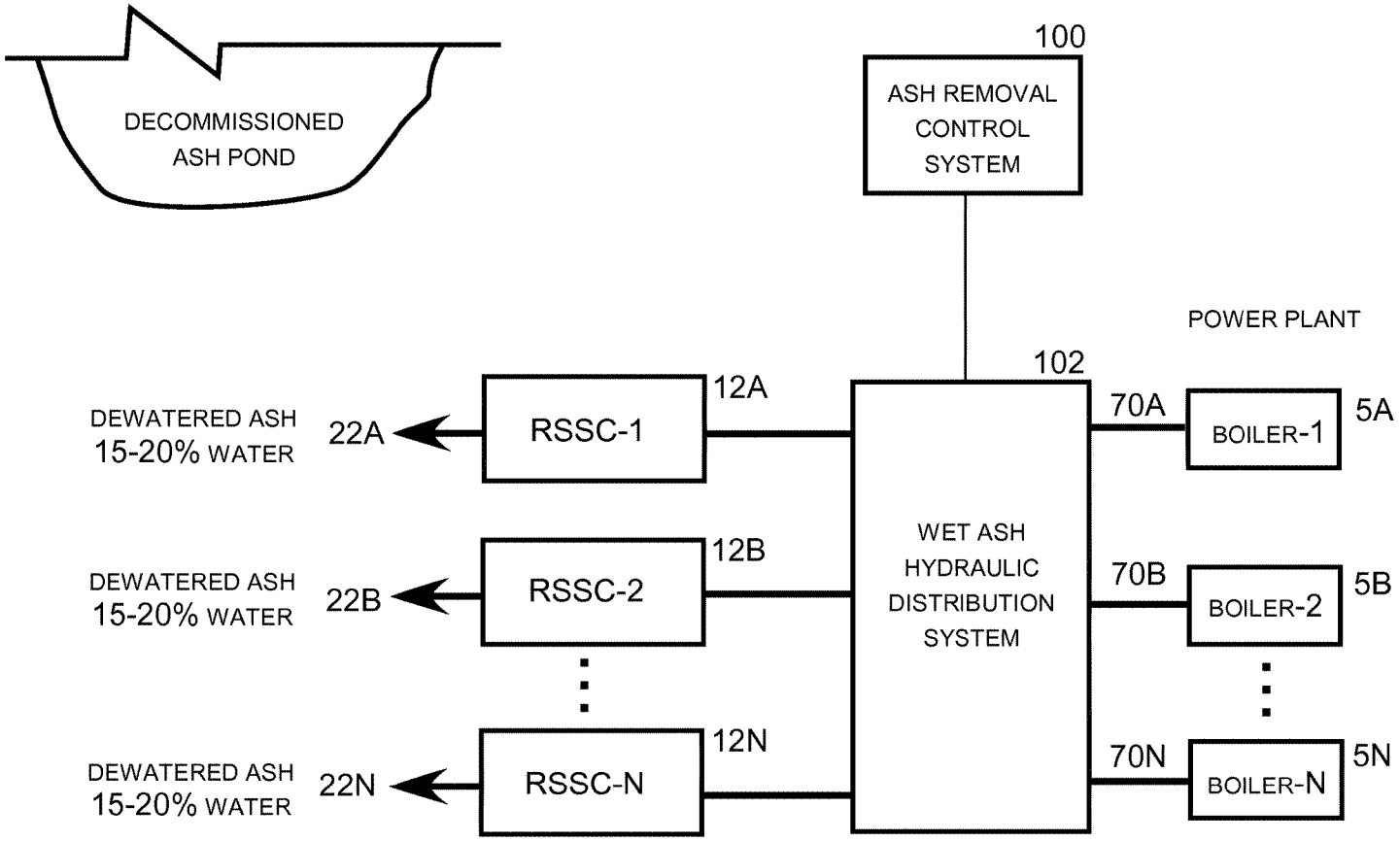
FIG. 9 is a schematic diagram of a Remote SSC bottom ash disposal system with a wet ash hydraulic distribution system.

FIG. 9 is a schematic diagram of a Remote SSC bottom ash disposal system with a wet ash hydraulic distribution system. FIG. 9 represent a generalized case in which any number of Remote SSCs 12A-N handle the bottom ash slurry discharges from any number of boilers 5A-N boilers.

An ash removal control system 100 controls the wet ash hydraulic distribution system 102 to direct the slurry discharge from any desired boiler to any desired Remote SSC. The wet ash hydraulic distribution system 102 typically includes pumps and valves for remotely controlling the delivery of bottom ash discharges to desired Remote SSCs as needed, which can be part of a comprehensive intelligent boiler cleaning system.

Figure 10:
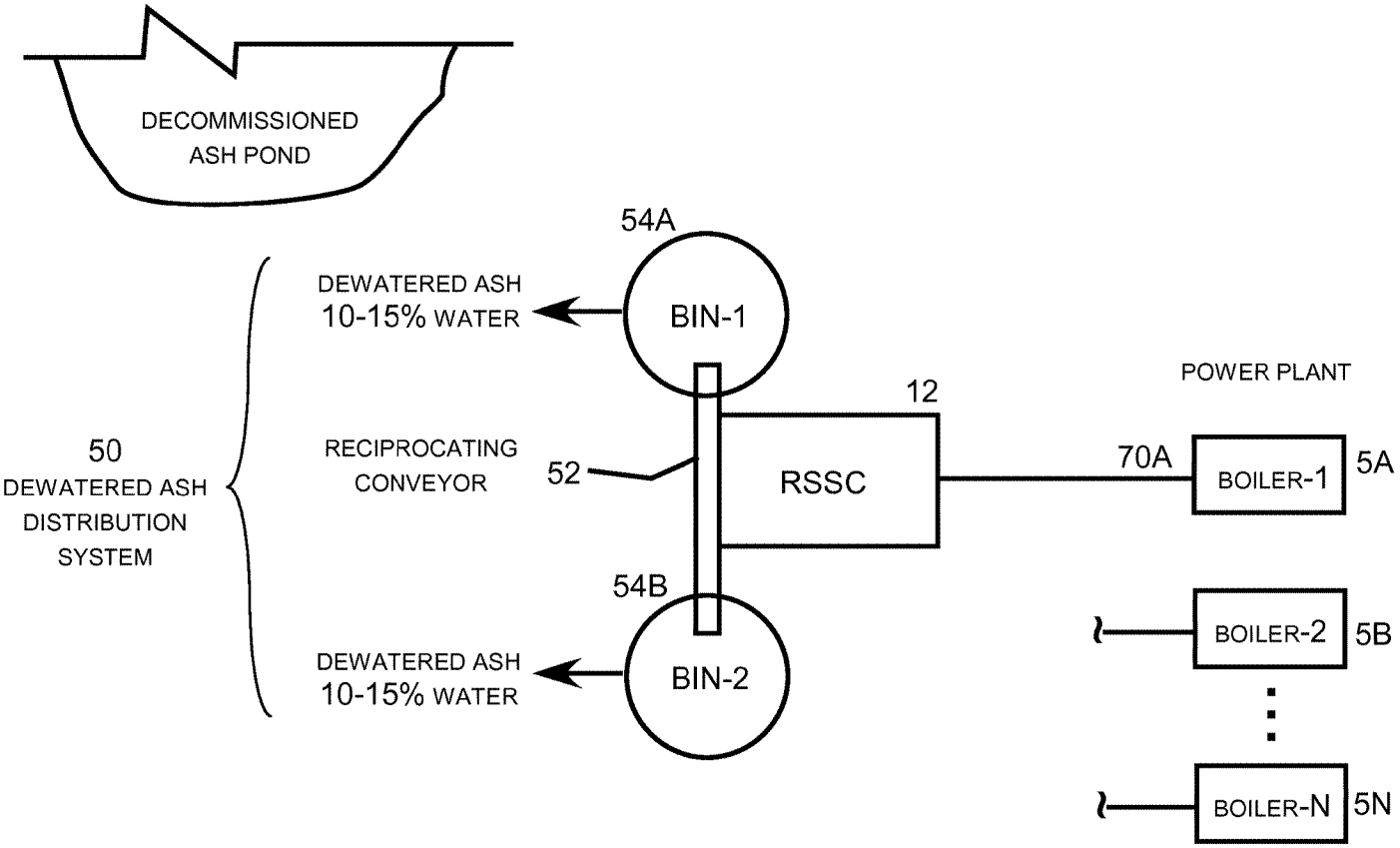
FIG. 10 is a schematic diagram of a Remote SSC bottom ash disposal system with a dewatered ash distribution system including a pair of mini-dewatering bins and a reciprocating conveyor.
Figure 11:
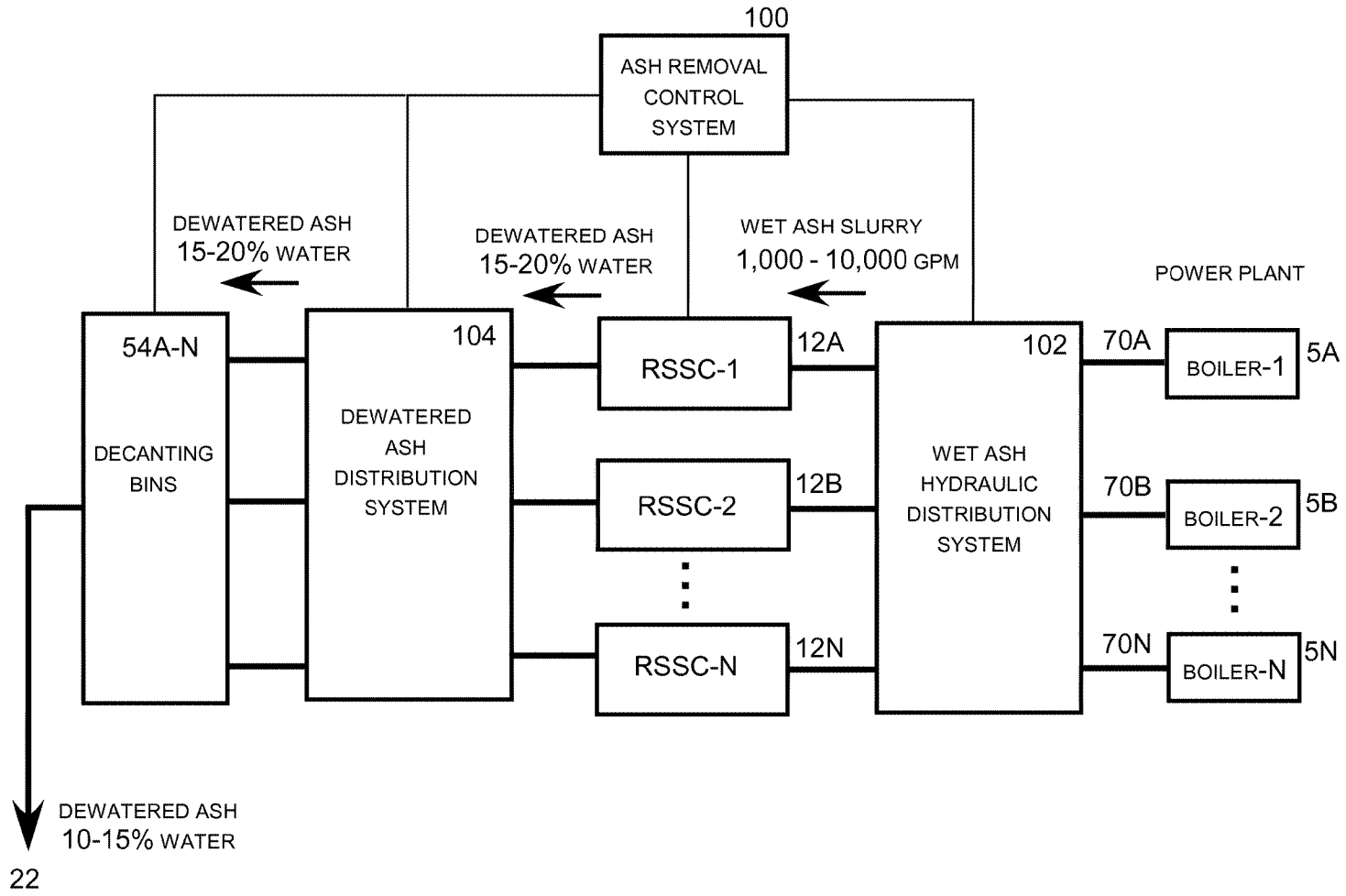
FIG. 11 is a schematic diagram of a Remote SSC bottom ash disposal system with a wet ash hydraulic distribution system and a dewatered ash distribution system.

FIG. 10 is a schematic diagram of a Remote SSC bottom ash disposal system including the dewatered ash distribution system 50 shown in FIG. 2, which includes a pair of mini-dewatering bins 54A-B and a reciprocating conveyor 52 serving a single Remote SSC 12. This is one example of a dewatered ash distribution system that is generalized on FIG. 11. In this example, the bottom ash dewatering system includes a generalized dewatered ash distribution system 104 handling the dewatered ash from any number of Remote SSCs 12A-N under the control of the ash removal control system 100. The ash removal control system 100 remotely controls the wet ash hydraulic distribution system 102 as well as the dewatered ash distribution system 104. The dewatered ash distribution system 104 typically includes chutes, conveyors, bins and storage piles for handling the dewatered ash as desired.

In view of the foregoing, it will be appreciated that present invention provides significant improvements in bottom ash dewatering systems and that numerous changes may be made therein without departing from the spirit and scope of the invention as defined by the following claims.

The invention claimed is:

1. A bottom ash dewatering system for a boiler, comprising:

a submerged scraper conveyor located remotely from the boiler, the submerged scraper conveyor comprising a horizontal section, a dewatering incline section, and a conveyor running through the horizontal and dewatering incline sections;

a slurry processing system integrated with the horizontal section of the submerged scraper conveyor for receiving a bottom ash slurry discharge from a remotely located slurry outlet of the boiler, separating bottom ash and overflow water from the slurry discharge, delivering the separated ash onto the conveyor, and delivering the overflow water to an overflow water processing system;

an ash hopper located under the boiler;

a slurry discharge pipe adapted to deliver a wet ash slurry from the ash hopper into the horizontal section of the submerged scraper conveyor such that ash in the slurry can settle onto the conveyor; and a pump adapted to discharge the ash slurry through the slurry discharge pipe from the ash hopper to the horizontal section of the submerged scraper conveyor;

wherein the slurry processing system comprises:

an overflow trough system comprising a series of overflow troughs comprising a first overflow trough and a second overflow trough; and a weir system comprising a series of weirs comprising a first weir located in a first water flow direction between the horizontal section of the submerged scraper conveyor and the first overflow trough and a second weir located in a second water flow direction between the horizontal section of the submerged scraper conveyor and the second overflow trough; and wherein the horizontal section has a water line defining a level above which water in the horizontal section will flow through the weir system and into the overflow trough system, wherein the conveyor runs through the horizontal section at a level below the water line;

wherein the slurry processing system further comprises an underflow baffle located over the conveyor within the horizontal section, wherein the underflow baffle is partially above the water line and extends downward to a position below the water line such that slurry received by the horizontal section is directed downwards by the underflow baffle toward the conveyor thereby allowing ash to settle out of the slurry by gravity while forcing water from the slurry to follow a tortuous path downward and then upward adjacent an outer surface of the underflow baffle and into the overflow water processing system.

2. The bottom ash dewatering system of claim 1, further comprising a wet ash hydraulic distribution system for selectively delivering bottom ash slurry discharges to the slurry processing system from a plurality of boilers.

3. The bottom ash dewatering system of claim 2, further comprising an ash removal control system for remotely controlling the wet ash hydraulic distribution system.

4. The bottom ash dewatering system of claim 1, further comprising a dewatered ash distribution system for selectively conveying dewatered ash discharged from the submerged scraper conveyor to a plurality of further dewatering locations.

5. The bottom ash dewatering system of claim 4, wherein the further dewatering locations include dewatering bins.

6. The bottom ash dewatering system of claim 4, further comprising an ash removal control system for remotely controlling the dewatered ash distribution system.

7. The bottom ash dewatering system of claim 1, wherein when the bottom ash slurry discharge comprises a flow of at least 1,000 gallons-per-minute (227 cubic meters/hour) to the horizontal section of the submerged scraper conveyor via the slurry discharge pipe, the submerged scraper conveyor is configured to discharge dewatered ash having water content not greater than 20% water by weight.

8. The bottom ash dewatering system of claim 5, wherein when the bottom ash slurry discharge comprises a flow of at least 1,000 gallons-per-minute (227 cubic meters/hour) to the horizontal section of the submerged scraper conveyor via the slurry discharge pipe, the dewatering bins are configured to discharge dewatered ash having water content not greater than 15% water by weight.

9. The bottom ash dewatering system of claim 1, wherein the underflow baffle system comprises an elongated box having an open bottom and sides positioned partially above the water line and extending downward to a position below the water line in the horizontal section of the submerged scraper conveyor.

10. The bottom ash dewatering system of claim 9, wherein the elongated box has a closed top.

11. The bottom ash dewatering system of claim 1, wherein the slurry discharge pipe is adapted to deliver a flow of at least 1,000 gallons-per-minute (227 cubic meters/hour) to the horizontal section of the submerged scraper.

12. The bottom ash dewatering system of claim 9, wherein the first weir and the second weir each comprise a mesh screen adjacent to and inclined away from the first and second overflow troughs, respectively, and extending from below the water line to above the water line.

13. The bottom ash dewatering system of claim 1, wherein the first and second overflow trough have a combined length of at least 79 feet.

14. The bottom ash dewatering system of claim 1, wherein the first and second overflow trough have a combined length of at least 110 feet.

15. The bottom ash dewatering system of claim 5, wherein:

when the bottom ash slurry discharge comprises a flow of at least 1,000 gallons-per-minute (227 cubic meters/hour) to the horizontal section of the submerged scraper conveyor via the slurry discharge pipe;

the submerged scraper conveyor is configured to discharge dewatered ash having water content not greater than 20% water by weight; and the dewatering bins are configured to discharge dewatered ash having water content not greater than 15% water by weight.

16. The bottom ash dewatering system of claim 9, wherein the discharge pipe is adapted to deliver the wet ash slurry into the elongated box of the underflow baffle system.

17. The bottom ash dewatering system of claim 9, wherein the elongated box has an open top.

18. The bottom ash dewatering system of claim 9, wherein the first weir and the second weir are each selected from the group consisting of: a flat weir; a serrated weir; an inclined mesh screen; and inclined parallel plates.

19. A bottom ash dewatering system for a boiler, comprising:

a submerged scraper conveyor comprising a horizontal section, a dewatering incline section, and a conveyor running through the horizontal and dewatering incline sections;

a slurry processing system integrated with the horizontal section of the submerged scraper conveyor for receiving a bottom ash slurry discharge from a remotely located slurry outlet of the boiler, separating bottom ash and overflow water from the slurry discharge, delivering the separated ash onto the conveyor, and delivering the overflow water to an overflow water processing system; and a slurry discharge pipe adapted to deliver a wet ash slurry from a remote location into the horizontal section of the submerged scraper conveyor such that ash in the slurry can settle onto the conveyor;

wherein the horizontal section has a water line defining a level above which water in the horizontal section will overflow into the overflow processing system, wherein the conveyor runs through the horizontal section at a level below the water line; and wherein the slurry processing system comprises:

an underflow baffle located over the conveyor within the horizontal section;

an overflow trough; and a weir located in a first water flow direction between the horizontal section of the submerged scraper conveyor and the first overflow trough;

wherein the underflow baffle is partially above the water line and extends downward to a position below the water line and below the weir such that slurry received by the horizontal section is directed downwards by the underflow baffle toward the conveyor thereby allowing ash to settle out of the slurry by gravity while forcing water from the slurry to follow a tortuous path downward and then upward adjacent an outer surface of the underflow baffle before flowing into the weir.

20. The bottom ash dewatering system of claim 19, wherein the underflow baffle comprises an elongated box having an open bottom and sides partially above the water line and extending downward to a position below the water line in the horizontal section of the submerged scraper conveyor.

21. The bottom ash dewatering system of claim 20, wherein the elongated box has a closed top.

22. The bottom ash dewatering system of claim 20, wherein the elongated box has an open top.

23. The bottom ash dewatering system of claim 19, wherein when the bottom ash slurry discharge comprises a flow of at least 1,000 gallons-per-minute (227 cubic meters/hour) to the horizontal section of the submerged scraper conveyor via the slurry discharge pipe, the submerged scraper conveyor is configured to discharge dewatered ash having water content not greater than 20% water by weight.

24. The bottom ash dewatering system of claim 19, wherein the slurry discharge pipe is adapted to deliver a flow of at least 1,000 gallons-per-minute (227 cubic meters/hour) to the horizontal section of the submerged scraper.

* * * * *